US007954351B2

(12) United States Patent
Noé

(10) Patent No.: US 7,954,351 B2
(45) Date of Patent: Jun. 7, 2011

(54) STRETCH-LEVELING METAL STRIP

(75) Inventor: Andreas Noé, Kerken (DE)

(73) Assignee: BWG Bergwerk-und Walzwerk-Maschinenbau GmbH, Duisburg (DE)

( * ) Notice: Subject to any disclaimer, the term of this patent is extended or adjusted under 35 U.S.C. 154(b) by 616 days.

(21) Appl. No.: 12/012,790

(22) Filed: Feb. 5, 2008

(65) Prior Publication Data

US 2008/0196467 A1 Aug. 21, 2008

(30) Foreign Application Priority Data

Feb. 7, 2007 (DE) ..... 10 2007 006 809

(51) Int. Cl.

| | |
|---|---|
| ***B21B 39/08*** | (2006.01) |
| ***B21B 37/74*** | (2006.01) |
| ***B21B 27/06*** | (2006.01) |
| ***B21D 1/02*** | (2006.01) |

(52) U.S. Cl. ..... 72/205; 72/12.2; 72/160; 72/202

(58) Field of Classification Search ..... 72/202, 72/205, 160–165, 12.2
See application file for complete search history.

(56) References Cited

U.S. PATENT DOCUMENTS

| | | | | |
|---|---|---|---|---|
| 4,765,169 | A * | 8/1988 | Bradlee | 72/202 |
| 6,327,883 | B1 | 12/2001 | Noe | |
| 7,013,693 | B2 | 3/2006 | Noe | |

* cited by examiner

*Primary Examiner* — Edward Tolan
*Assistant Examiner* — Mohammad Yusuf
(74) *Attorney, Agent, or Firm* — Andrew Wilford

(57) ABSTRACT

A metal strip is stretched as it is moved longitudinally generally continuously between an upstream traction-roll set and a downstream traction-roll set. The roll sets are differentially driven—with the downstream set moving at a slightly higher peripheral speed than the upstream set—so as to apply to the strip in a region between the sets a tension generally equal to a stretch limit of the strip. The strip is locally heated or cooled at an upstream location in the region between the roll sets so as to set in the strip in the region a temperature distribution that is nonhomogeneous transversely across the strip at least immediately downstream of the upstream location.

19 Claims, 1 Drawing Sheet

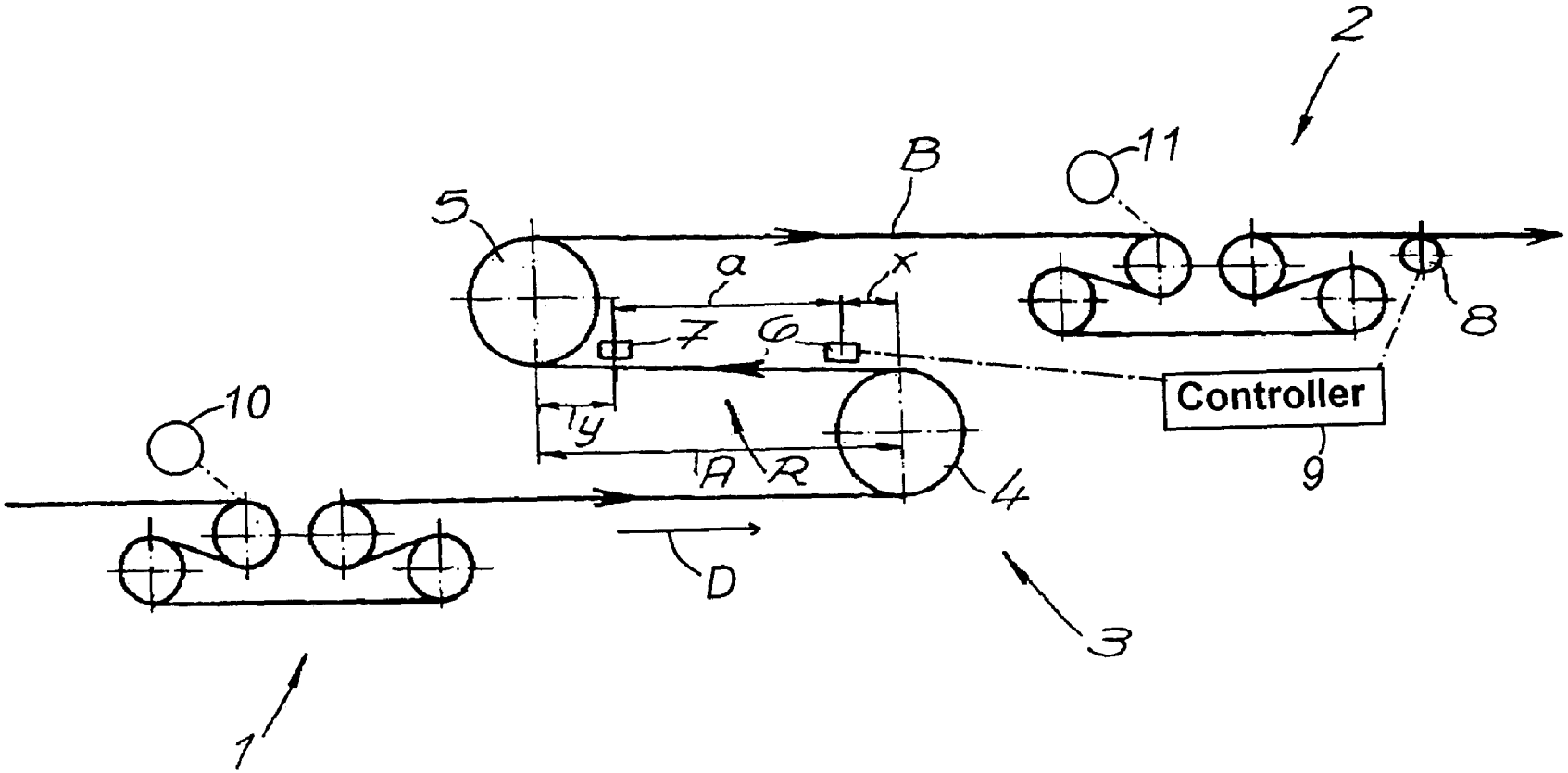
2
8
Controller
9
11
3
4
B
x
6
R
A
D
α
7
y
5
10
1

STRETCH-LEVELING METAL STRIP

FIELD OF THE INVENTION

The present invention relates to stretch-leveling metal strip. More particularly this invention concerns a method of and apparatus for stretch-leveling a metal strip.

BACKGROUND OF THE INVENTION

Metal strip is normally produced in a continuous process involving extrusion and/or rolling. The strip produced in this manner normally must undergo a leveling process whereby its is rendered planer. With thin metal strip of aluminum alloy, this is typically done as the strip is advanced in its longitudinal travel direction by plastically deforming it in one or in several stretch-leveling zones under a tension generally at or above the stretch limit. Thin metal strip signifies in particular metal strip with a thickness of 0.05 to 1 mm, preferably 0.1 to 0.5 mm. The stretch-leveling zone usually is that region of the strip in a strip treatment installation between two driven rolls where the strip is plastically lengthened and maintained under a tension about equal to the stretch limit.

With continuous stretch-leveling the strip runs through an upstream set of braking rolls and a downstream set of traction rolls and is subjected to stretch leveling between the two sets of rolls as a result of being plastically stretched. The strip can run through several such stretch zones between respective sets of rolls and be stretched in each these stretch zones in the plastic range and/or in the elastic range (see U.S. Pat. No. 7,013,693).

In addition to stretch leveling, the leveling of metal strip can also be done by rolls, e.g. by dressing rolls and/or by leveling. In practice, corrugations or strip saber cannot be completely eliminated with the known methods of leveling metal strip by rolls, leveling and/or stretch leveling, so that a perfectly level condition is rarely achieved.

For this reason it has been suggested, especially during rolling, that a temperature profile that can be varied over the strip width and optionally over a given strip length be created in the metal strip by heating or cooling locally in order to influence the distribution of the tensile stress. The degree of leveling is consequently adjusted in this case by varying the distribution of the tensile stress (see U.S. Pat. No. 6,327,883).

OBJECTS OF THE INVENTION

It is therefore an object of the present invention to provide an improved stretch-leveling metal strip.

Another object is the provision of such an improved stretch-leveling metal strip that overcomes the above-given disadvantages, in particular such that the surface planarity of the metal strip can be improved in a simple and at the same time economical manner during stretch leveling.

SUMMARY OF THE INVENTION

A metal strip is stretched as it is moved longitudinally generally continuously between an upstream traction-roll set and a downstream traction-roll set. The roll sets are differentially driven—with the downstream set moving at a slightly higher peripheral speed than the upstream set—so as to apply to the strip in a region between the sets a tension generally equal to a stretch limit of the strip. The strip is locally heated or cooled at an upstream location in the region between the roll sets so as to set in the strip in the region a temperature distribution that is nonhomogeneous transversely across the strip at least immediately downstream of the upstream location.

Thus the invention is thus a generic method of the continuous stretch leveling of metal strip whereby the metal strip is locally heated and/or cooled in at least one stretch zone in order to set a temperature distribution over the strip width that is nonhomogeneous over the strip width. The invention starts from the recognition that the stretch leveling method can be influenced in a particularly sensitive manner if the strip is heated locally within one or more stretch zones during the plastic deformation. The strip is consequently not already heated before entering the stretch-leveling zone, where the stretching takes place still below the stretch limit, but rather only when it is actually in the stretch zone. Consequently, the strip is already under tension generally at the stretch limit $\sigma_s$ before the heating starts. It is especially significant here that the distribution of the tensile stress in the strip does not vary by for example the heating of a strip when assuming ideal plastic material behavior. Ideal plastic material signifies in the framework of the invention a material in which no or only a negligibly small cold hardening takes place during plastic deformation. However, even in the case of a slight cold hardening it can be assumed from the fact that the distribution of tensile stress varies only negligibly if a strip is heated in a stretch zone in which the strip is under tension generally at the stretch limit. However, the stretch leveling method can be locally influenced by heating such a strip within the stretch-leveling zone because a difference in the plastic lengthening between the individual strip with different temperatures results directly from the thermal expansion of the heated strip (and not for example by a different distribution of the tensile stress).

The following applies for a non-heated or cold strip:

$$\epsilon_{tot}=\sigma_s/E+\epsilon_{p,\ cold}$$

In contrast thereto, the following applies for a heated strip:

$$\epsilon_{tot}=\sigma_s/E+\epsilon_{p,\ hot}+\alpha^*\Delta T$$

where $\epsilon_{tot}$ signifies the total expansion.

$\sigma_s$ is the stretch limit.

E is the modulus of elasticity.

$\alpha$ is the coefficient of thermal expansion.

$\Delta T$ is the (relative) heating of the heated strip in ° C.

$\epsilon_{p,\ hot}$ and $\epsilon_{p,\ cold}$ are the plastic expansions of the heated and cold strip.

Since the total expansion $\epsilon_{tot}$ is identical for on the one hand the cold strip and on the other hand the warm strip inside the stretch-leveling zone, it follows directly from the relations explained above that the distribution of the plastic lengthening over the strip width is a direct function of the temperature difference $\Delta T$:

$$\Delta\epsilon_p=\epsilon_{p,\ cold}-\epsilon_{p,\ hot}+\alpha^*\Delta T$$

The distribution of plastic elongation across the strip width can therefore be directly influenced via the introduced temperature differences. The setting of the temperature distribution forms as it were a further correcting element for the surface planarity. As a result, metal strip with an especially high surface planarity can be produced in the method in accordance with the invention. In addition, the method of the invention is characterized by high flexibility. Furthermore, the fact is especially significant that the temperature loading of the strip takes place within the stretch-leveling zone and consequently downstream of the upstream traction roll of the pair of traction rolls. Consequently, influencing of the temperature of the stretch leveling roll is excluded, which could otherwise influence the stretch leveling method in an undesired manner.

In this connection the invention suggests in an especially advantageous embodiment that the metal strip be heated and/or cooled (at least) locally subsequently in the same stretch zone in order to adjust the temperature distribution across the strip width so that it is homogeneous over the strip width. The invention starts from the recognition here that it is especially advantageous to compensate out the temperature profile again, which is at first nonhomogeneous, in the same stretch zone and consequently to subsequently eliminate the temperature differences in the strip. Consequently, the strip again has a constant temperature across the strip width after being stretched. It is especially advantageous to carry out this temperature compensation still within the same stretch zone since in this manner a nonhomogeneous temperature influencing of the upstream stretch leveling roll as well as of the downstream stretch leveling roll of a pair of stretch leveling rolls is reliably avoided. This is in particular advantageous when different strip or coils that require different temperature distributions for leveling are treated one after the other in one and the same apparatus because it is reliably avoided in this manner that after the treatment of a first coil with a certain temperature distribution this temperature distribution is transferred onto one or more rolls of the stretch leveling apparatus. This means that the influence of the previously heated roll does not have to be taken into account during the subsequent treatment of another coil.

In order to make the temperature profile uniform the invention provides the possibility that the strip is subsequently inversely temperature controlled in areas that were first heated (or cooled), and consequently heated regions are cooled and/or cooled regions are heated. However, there is also the possibility that the previously heated regions are not subsequently heated but rather that precisely those regions are heated that were not previously heated. The temperature profile can also be made uniform in this manner without cooling elements being necessary.

The invention furthermore suggests that the temperature distribution is measured in the stretch zone and/or downstream of the stretch zone and that the setting of the temperature profile is controlled with or without feedback as a function of these measured results. The method can be easily monitored by determining the temperature distribution so that in particular even changing strip speeds can be followed.

Moreover, there is the possibility that the surface planarity of the strip is measured in the stretch zone and/or downstream of the stretch zone and that the setting of the temperature profile is controlled and/or set as a function of this measuring.

The subject of the invention is also an apparatus for stretch-leveling metal strip, especially thin metal strip, in accordance with a method of the described type. Such a stretch-leveling apparatus comprises at least one pair of traction-stretching rolls that forms a stretch zone between an upstream traction-stretching roll and a downstream traction-stretching roll. Such a stretching apparatus preferably comprises at least one set of intake rolls, e.g. a set of braking rolls, and at least one set of output rolls, e.g. a set of tensioning rolls, and at least one pair of traction rolls is provided between the set of intake rolls and the set of output rolls. However, the invention also includes embodiments with several stretch zones and in particular with several pairs of traction-stretching rolls.

According to the invention at least an upstream temperature-controlling device with one or more heating elements and/or cooling elements for setting a temperature profile that is nonhomogeneous across the strip width is provided in the stretch zone and/or in the stretch zones or at least in one of the stretch zones. Furthermore, it is especially advantageous if a downstream temperature-controlling device is provided downstream at a given distance in the same stretch zone of this upstream temperature-controlling device and also comprises one or more heating elements and/or cooling elements for setting a temperature profile that is homogeneous across the strip width. Whereas the nonhomogeneous temperature profile necessary for influencing the traction stretching method is set by the upstream temperature-controlling device, the downstream temperature-controlling device serves to even out the temperature profile that was set upstream.

Such a temperature-controlling device can comprise several (separate) heating elements and/or cooling elements distributed across the strip width. However, it is also within the scope of the invention that such a temperature-controlling device comprises one or more heating elements and/or cooling elements that can be moved transversely across the strip width. The heating elements can be radiant heaters, e.g. infrared radiators. Alternatively, or in addition, even induction heating elements or heating elements of another type can be used as heating elements. Cooling elements can be designed, e.g. as air-blower elements for blowing cool air.

In a preferred embodiment the upstream temperature-controlling device, by means of which a nonhomogeneous temperature profile is set across the strip width, is provided immediately downstream of the upstream traction-stretching roll, that is, the temperature control takes place at the beginning of the traction stretch zone. It is furthermore advantageous if the downstream temperature-controlling device, by means of which the nonhomogeneous temperature profile is reset, is provided immediately upstream of or closely upstream from the downstream traction-stretching roll or in the downstream end of the traction stretch zone. It is for example advantageous in this connection if the distance between the upstream temperature-controlling device and the downstream temperature-controlling device is at least one half the length of the stretch zone or one half the distance between the rolls of a pair of traction-stretching rolls.

In a further embodiment according to the invention at least one temperature-measuring device is provided in the stretch zone and/or downstream of the stretch zone, which device can be connected to a control apparatus operating with or without feedback that for its part is connected to one or to several temperature-controlling devices. Furthermore, it can be advantageous if a surface-planarity measuring device is provided in the stretch zone and/or downstream of the stretch zone that can also be connected to a control- and/or regulating apparatus that works for its part on the temperature-controlling devices.

BRIEF DESCRIPTION OF THE DRAWING

The above and other objects, features, and advantages will become more readily apparent from the following description, reference being made to the accompanying drawing whose sole FIGURE is a partly schematic side view of the apparatus for carrying out the method of this invention.

SPECIFIC DESCRIPTION

As seen in the drawing a traction-stretching apparatus according to the invention has a set 1 of braking intake rolls 1 and a set 2 of overdriven traction output rolls with respective drives 10 and 11 operated by a common controller 9. A traction-stretching roll pair 3 provided between the braking-roll set 1 and the traction-roll set 2 forms a stretch zone R between an upstream traction-stretching roll 4 and a downstream traction roll 5. The braking-roll set 1 and the traction-roll set 2 each have several rolls that are driven with staggered torques/speeds and exert traction in the stretch R in order to stretch a band B moving in a direction D between the braking-roll set 1 and the traction-roll set 2. The traction-stretching rolls 4 and 5 of traction-stretching roll pair 3 are also correspondingly driven so that in the stretch zone R the strip B is under tension generally at the stretch limit and is plastically deformed and lengthened.

According to the invention an upstream temperature-controlling device 6 is provided in this stretch zone R and comprises a plurality of heating and/or cooling elements spaced transversely across the strip B, although it is possible for it to have a single such element that is transversely shiftable. A temperature profile that is nonhomogeneous across the strip width is produced with the aid of this upstream temperature-controlling device 6 immediately downstream of the upstream traction-stretching roll 4 and consequently during plastic deformation of the metal strip B by stretching. The strip B is locally heated or cooled in one or more selected stripes extending in the travel direction D. This local heating and the introduced temperature differences directly influence the plastic elongation so that the traction stretching method can be influenced in a sensitive manner. Cold areas are elongated more than correspondingly heated areas. The upstream temperature-controlling device 6 is provided immediately downstream of the upstream roll 4 of the traction-stretching roll pair 3. The temperature of the strip is consequently modified immediately after it leaves the upstream roll 4.

A downstream temperature-controlling device 7 is provided in the same stretch zone R but spaced by a distance a downstream of the upstream temperature-controlling device 6. This temperature-controlling device 7 also comprises one or more heating elements and/or cooling elements with which the temperature profile that had previously been nonhomogeneously set can subsequently be evened out again. The strip B consequently leaves the stretch zone R with a temperature that is constant across the strip width. As a consequence, none of the functioning rolls engages a nonhomogeneously tempered strip according to the invention so that there is no danger that a roll heats up or cools down locally. This ensures that the method in accordance with the invention can be carried out in an especially reliable manner.

A distance A between the two traction-stretching rolls 4 and 5 or the length of the stretch zone R is normally up to 5 m, e.g. 2 m to 3 m. The upstream temperature-controlling device 6 is provided immediately downstream of the traction-stretching roll 4 so that the temperature of the strip B is set immediately after it leaves the upstream roll 4. Immediately downstream of the upstream traction-stretching roll here means in the upstream half of the stretch zone, preferably in the upstream third of the stretch zone, and most preferably in the upstream fourth of the stretch zone. A spacing x of the temperature-controlling device from the traction-stretching roll 4 is preferably less than 1 m, e.g. less than 0.5 m.

The downstream temperature-controlling device 7 is provided immediately upstream of the downstream traction-stretching roll 5. Immediately upstream of the downstream traction-stretching roll here means in the downstream half of the stretch zone, preferably in the downstream third of the stretch zone, and most preferably in the downstream fourth of the stretch zone. A spacing y between the downstream temperature-controlling device 7 and the downstream traction-stretching roll 5 is for example less than 1 m, preferably less than 0.5 m. To this extent it is advantageous if distance a between both the temperature-controlling devices is as big as possible relative to the distance A between the traction-stretching rolls 4 and 5. The distance a is preferably at least half the distance A between the traction-stretching rolls 4 and 5. Spacing signifies in the framework of the invention the distance or dimension along the strip B, e.g. the distance of the temperature-controlling device or of the corresponding tempered strip portion to the portion where the strip leaves contact with the roll or where the strip comes into contact with the roll.

Furthermore, a surface-planarity detector 8, e.g. a surface-planarity measuring roll or also a contactless surface-planarity detector can be provided in the traction stretching apparatus, e.g. downstream of the traction-stretching roll pair 3 and optionally also downstream of the traction-roll set 2. The surface planarity of strip B created during the traction stretching can consequently be directly measured and/or checked. The measured result can be supplied to a control apparatus working with or without feedback and connected to the individual components of the traction stretching apparatus and in particular also to the temperature-controlling devices 6 and 7. This is not shown in the drawing. This detector 8 can also sense the temperature of the strip B and feed this information, like the planarity information, to the controller 9 for operating the devices 6 and 7.

I claim:

1. A method of stretch-leveling a metal strip, the method comprising the step of:

moving the strip longitudinally generally continuously between an upstream traction-roll set and a downstream traction-roll set;

differentially operating the roll sets so as to apply to the strip in a region having an upstream end downstream of the upstream set and a downstream end upstream of the downstream set a tension generally equal to or greater than a stretch limit of the strip; and locally heating or cooling the strip at an upstream location in the region between the roll sets and thereby setting in the strip in the region a temperature distribution that is nonhomogeneous transversely across the strip at least immediately downstream of the upstream location.

2. The stretch-leveling method defined in claim 1, further comprising the step of:

locally cooling or heating the strip at a location in the region downstream of the upstream location so as to render the temperature distribution of the strip generally homogenous across the strip downstream of the downstream location.

3. The stretch-leveling method defined in claim 2 wherein in the downstream location any portions of the strip that were heated in the upstream location are cooled.

4. The stretch-leveling method defined in claim 2 wherein in the downstream location any portions of the strip that were cooled in the upstream location are heated.

5. The stretch-leveling method defined in claim 2 wherein in the downstream location any portions of the strip that were not heated are heated to generally the same temperature as the portions that were heated.

6. The stretch-leveling method defined in claim 1, further comprising the steps of:

measuring the temperature of the strip downstream of the downstream roll set at locations spaced transversely across the strip; and controlling the heating or cooling of the strip at the upstream location in accordance with the temperature measurements.

7. The stretch-leveling method defined in claim 1, further comprising the steps of:

measuring planarity of the strip downstream of the downstream roll set; and controlling the heating or cooling of the strip at the upstream location in accordance with the planarity measurements.

8. An apparatus for stretch-leveling a metal strip, the method comprising the step of:

means for moving the strip longitudinally generally continuously between an upstream traction-roll set and a downstream traction-roll set;

drive means for differentially operating the roll sets so as to apply to the strip in a region having an upstream end downstream of the upstream set and a downstream end upstream of the downstream set a tension generally equal to or greater than a stretch limit of the strip; and upstream means including at least heating or cooling element at an upstream location in the region between the roll sets for locally heating or cooling the strip and thereby setting in the strip in the region a temperature distribution that is nonhomogeneous transversely across the strip at least immediately downstream of the upstream location.

9. The stretch-leveling apparatus defined in claim 8, further comprising downstream means including at least one heating or cooling element at a downstream location in the region between the roll sets downstream of the upstream location for locally heating or cooling the strip and thereby setting in the strip in the region a temperature distribution that is homogeneous transversely across the strip at least immediately downstream of the downstream location.

10. The stretch-leveling apparatus defined in claim 9 wherein the upstream means is immediately downstream of the upstream roll set and the downstream means is immediately upstream of the downstream roll set.

11. The stretch-leveling apparatus defined in claim 10 wherein the upstream means is in an upstream one-quarter of the region and the downstream means is in a downstream one-quarter of the region.

12. The stretch-leveling apparatus defined in claim 8 wherein the upstream means includes a plurality of the heating or cooling elements.

13. The stretch-leveling apparatus defined in claim 8 wherein the heating or cooling element can be shifted transversely across the strip.

14. The stretch-leveling apparatus defined in claim 8 wherein the heating or cooling element is a IR radiator or induction heater.

15. The stretch-leveling apparatus defined in claim 8, further comprising sensor means downstream of the downstream roll set for measuring the temperature distribution transversely across the strip; and control means connected between the sensor means and the heating/cooling means for operating the latter in accordance with measurements done by the sensor means.

16. The stretch-leveling apparatus defined in claim 8, further comprising sensor means downstream of the downstream roll set for measuring planarity of the strip; and control means connected between the sensor means and the heating/cooling means for operating the latter in accordance with measurements done by the sensor means.

17. The stretch-leveling apparatus defined in claim 8, further comprising upstream and downstream rolls engaging the strip between the upstream rolls and the downstream rolls and defining the upstream and downstream ends of the region.

18. The stretch-leveling apparatus defined in claim 8, further comprising drive means for operating the upstream and downstream rolls at different speeds to set tension in the region generally equal to or greater than a stretch limit of the strip.

19. The stretch-leveling method defined in claim 1, further comprising passing the strip around differentially driven upstream and downstream rolls defining the upstream and downstream ends of the region.

* * * * *